US008920021B2

(12) United States Patent
Mertenat

(10) Patent No.: US 8,920,021 B2
(45) Date of Patent: Dec. 30, 2014

(54) COLUMN WHEEL AND CHRONOGRAPH MECHANISM INCLUDING THE SAME

(71) Applicant: ETA SA Manufacture Horlogere Suisse, Grenchen (CH)

(72) Inventor: Olivier Mertenat, Solothurn (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 93 days.

(21) Appl. No.: 13/693,689

(22) Filed: Dec. 4, 2012

(65) Prior Publication Data

US 2013/0148475 A1 Jun. 13, 2013

(30) Foreign Application Priority Data

Dec. 8, 2011 (EP) ..... 11192668

(51) Int. Cl.
*G04F 7/08* (2006.01)
*G04B 13/02* (2006.01)

(52) U.S. Cl.
CPC ..... *G04F 7/0847* (2013.01); *G04B 13/02* (2013.01)
USPC ..... 368/101; 368/220

(58) Field of Classification Search
CPC ..... G04F 7/08; G04F 7/0847; G04F 7/0842; G04B 13/02
USPC ..... 368/101–106, 220, 110, 112, 113
See application file for complete search history.

(56) References Cited

U.S. PATENT DOCUMENTS

| | | | | | |
|---|---|---|---|---|---|
| 235,794 | A | * | 12/1880 | Meylan | 368/103 |
| 355,403 | A | * | 1/1887 | Lecoultre | 368/102 |
| 360,777 | A | * | 4/1887 | Lugrin | 368/104 |
| 449,915 | A | * | 4/1891 | Peguet | 368/103 |
| 826,444 | A | | 7/1906 | Petrillo | |
| 2,355,371 | A | * | 8/1944 | Furbach | 368/103 |
| 2009/0034373 | A1 | * | 2/2009 | Journe | 368/106 |
| 2012/0057434 | A1 | * | 3/2012 | Rudaz | 368/28 |
| 2012/0069717 | A1 | | 3/2012 | Mertenat | |

FOREIGN PATENT DOCUMENTS

| | | | |
|---|---|---|---|
| CH | 6505 | | 4/1893 |
| EP | 2 228 692 | A1 | 9/2010 |
| WO | WO 2010103060 | A1 * | 9/2010 |

OTHER PUBLICATIONS

European Search Report issued Aug. 9, 2012 in corresponding European Application No. 11 19 2668 filed on Dec. 8, 2011 (with an English Translation).

* cited by examiner

*Primary Examiner* — Amy Cohen Johnson
*Assistant Examiner* — Matthew Powell
(74) *Attorney, Agent, or Firm* — Oblon, Spivak, McClelland, Maier & Neustadt, L.L.P.

(57) ABSTRACT

The column wheel (40) for a 3 stroke mechanism has a hub (46) arranged at the centre of a superstructure exhibiting rotational symmetry of order n, the superstructure including n radial arms (48) and n columns (44) parallel to the axis of rotation of the column wheel, the columns being regularly distributed along the circumference of the column wheel and separated from each other by n empty spaces forming as many openings between the columns. The column wheel is characterized in that the width of the columns (44) is larger than the openings between the columns, and in that the width of the arms (48) is less than half the width of the columns (44).

7 Claims, 8 Drawing Sheets

COLUMN WHEEL AND CHRONOGRAPH MECHANISM INCLUDING THE SAME

This application claims priority from European Patent Application No. 11192668.9 filed Dec. 8, 2011, the entire disclosure of which is incorporated herein by reference.

FIELD OF THE INVENTION

The present invention concerns a three-stroke chronograph mechanism arranged to control a chronograph hand and at least one counter hand for starting, stopping and quickly returning the hands to their starting point, on demand, by successive applications of pressure on the same push-button. The present invention more particularly concerns a three-stroke chronograph mechanism of this type comprising a column wheel and in which the successive applications of pressure on the push button have the effect of gradually incrementing the angular position of the column wheel.

PRIOR ART

Chronograph mechanisms corresponding to the above definition are well known to those skilled in the art. In particular, the work of Mr B Humbert entitled "Le chronograph, son fonctionnement, sa réparation" (*The chronograph: its mechanism and repair*) (5th edition), published by Editions Scriptar S.A., La Conversion (Switzerland), 1990, discloses this type of chronograph in detail, setting out the peculiarities of a certain number of known variants.

FIG. 1 annexed hereto shows a known column wheel. As shown in the Figure, the column wheel is essentially formed of a ratchet wheel "r" and six teeth or columns "e" carried on the edge of the ratchet. Nowadays the ratchet wheel and columns are generally integral with each other, and as seen in the Figure, the shape of the transverse section of the columns is conventionally a substantially truncated triangle. This characteristic shape is linked to the use of a trimming cutter to sculpt the columns into the thickness of the plate of the wheel. The column wheel generally carries five or six columns (six in the illustrated example), and, in the case of a three-stroke chronograph, the ratchet includes 3 teeth for each column (the ratchet includes 18 teeth in the illustrated example). When it is not being activated, the column wheel is held in a stable angular position by a jumper spring (not shown) the end of which abuts on the ratchet. The column wheel is also controlled by the action of a click (not shown). The click is arranged to cooperate with the ratchet and is controlled by the push button. Each application of pressure on the push button has the effect of moving the click to move the column wheel forward through the angular value of one ratchet tooth.

Normally three applications of pressure on the push button are required, for one column to take the place of the preceding one, which corresponds to the conventional three functions of the chronograph: start, stop and reset. These functions are released by pivoting control parts (or levers) which are arranged to be activated in turn by the columns of the column wheel. The pivoting parts are arranged so that the trajectory defined by the step by step progression of the columns intersects that of the beaks of the pivoting parts. Thus, when a column meets the beak of a pivoting part, it forces the beak to be raised. Then, when moving further forward, the column is released from under the beak, the beak can drop into the space between two columns, thus allowing the pivoting part to be lowered. It is thus clear that it is the angular position of the column wheel which determines the release or interruption of the functions of the chronograph mechanism.

In order to have optimum precision as to the precise moment when the beak of one lever or another is raised and drops down into the space between two columns, the beaks of the various pivoting parts are given quite complex shapes. Moreover, it is usually necessary to touch up the pivoting part beaks once the chronograph mechanism has been assembled, which considerably increases the cost price of the chronographs. Further, the beaks of the pivoting control parts may have very varied shapes as demonstrated by the diagram of FIG. 2 which is taken from the aforementioned book. This diversity of shape makes it difficult to standardise the production of chronographs. Finally, the diagram of FIG. 2 also shows that the width of the beaks is greater than that of the columns. The result of this very common feature is a reduction in the length available for the travel of the beaks in the space between two columns. Consequently, the levers and columns are subjected to considerable mechanical forces. It would therefore be useful to make a chronograph mechanism in which the intensity of mechanical forces is less than in existing mechanisms.

BRIEF SUMMARY OF THE INVENTION

It is an object of the present invention to overcome the aforementioned drawbacks of the prior art. The present invention achieves this object by providing a column wheel according to the annexed claim 1, and a chronograph mechanism according to claim 7.

BRIEF DESCRIPTION OF THE DRAWINGS

Other features and advantages of the invention will appear upon reading the following description, given solely by way of non-limiting example, with reference to the annexed drawings, in which.

DETAILED DESCRIPTION OF ONE EMBODIMENT

Figure 9:
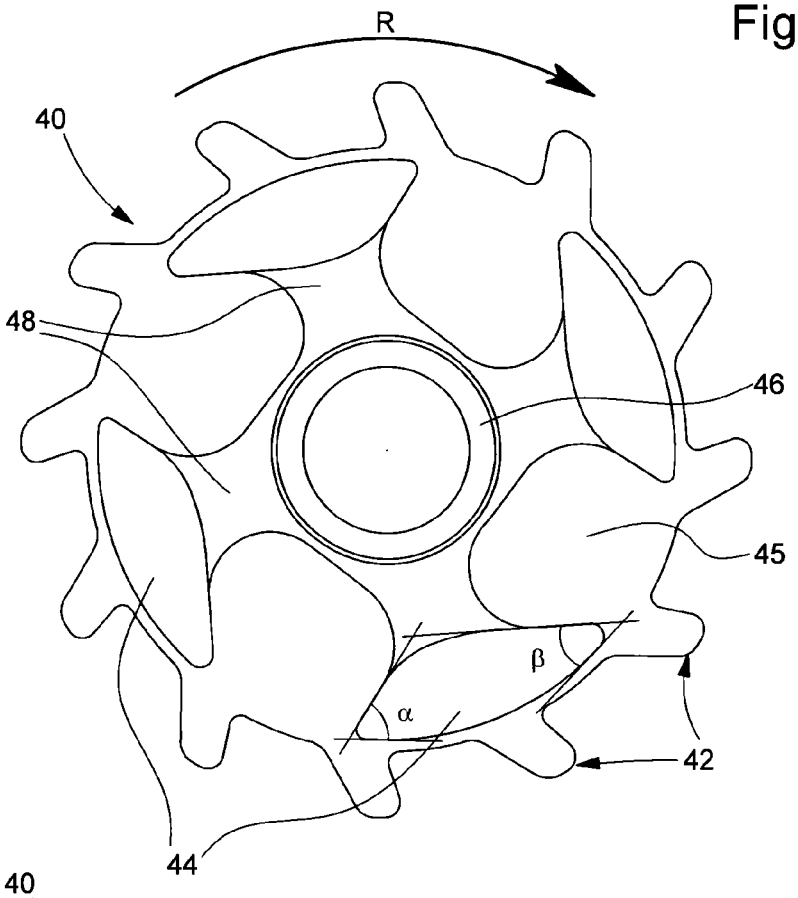
FIG. 9 is a top plan view of the column-wheel of the chronograph mechanism of FIGS. 3 to 8.
Figure 10:
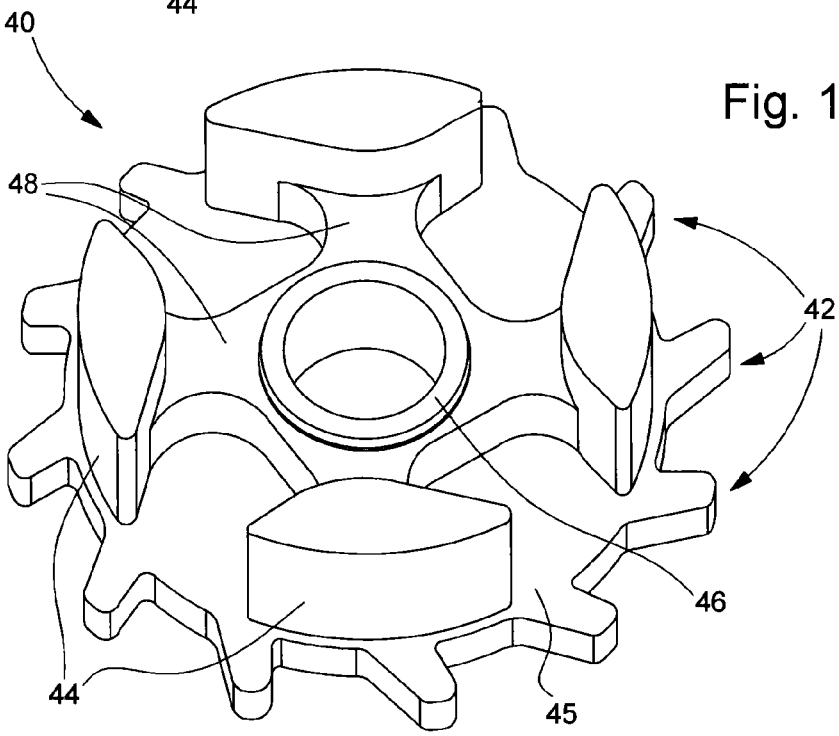
FIG. 10 is a perspective view of the column-wheel of FIG. 9.

Referring first of all to FIGS. 9 and 10, which show a column wheel 40 according to a particular embodiment of the present invention, it is seen that the wheel is essentially formed of a ratchet 42 and four columns 44 regularly distributed over the circumference of the ratchet. The column wheel further includes a hub 46 arranged to be pivotally mounted about an axis of the chronograph mechanism (not shown in FIGS. 9 and 10). FIG. 9 also contains an arrow reference R for indicating the direction of rotation of column wheel 40. It will be noted that this is the clockwise direction in this example.

In the example shown, the column wheel further includes four arms 48 which respectively connect the four columns 44 to hub 46 of the wheel. Columns 44, arms 48 and hub 46 thus form a superstructure with rotational symmetry of order 4. Ratchet 42 has 12 teeth separated from each other by 30°. Those skilled in the art will therefore understand that the column-wheel of the present example is a 12/4 stroke column-wheel (3 stroke).

The perspective view of FIG. 10 clearly shows hub 46 and arms 48 which connect the columns to the hub. The presence of the arms and the hub make the structure of the wheel in general and the columns in particular more rigid. It will be clear that a more rigid column wheel allows operation with a particularly high level of accuracy. It may also be observed that the width of the arms at their narrowest point is considerably less than the width of the columns (the width of a column is defined here as the distance separating the leading edge from the trailing edge of said column). According to the invention, the width of arms 48 is less than half the width of columns 44. In the present example, the width of an arm is even around a third of the width of a column. This feature of the invention means spaces 45 can be arranged in the column wheel superstructure. These spaces are necessary to allow the beaks of the various pivoting parts to drop sufficiently far down between the columns.

FIG. 10 also shows that the height of hub 46 and arms 48 is less than that of columns 44. The height of the arms will preferably be between 20% and 60% of the height of the columns. One advantage of this latter feature is that it means that the travel of a lever beak can be extended, provided that the lever is mounted sufficiently high to allow the beak to pass above arms 48 of the column wheel. Preferably, the column wheel is made entirely on a lathe. Uninterrupted fabrication on a lathe gives the part remarkable precision.

FIG. 9 clearly shows the profile of columns 40. It may be observed that the profile of the columns generally corresponds to a warped ellipsis, or perhaps more precisely to the profile of an aeroplane wing. The front side of the columns (with reference to the direction of rotation of the column wheel) will thus be designated the "leading edge", and the back edge will be designated the "trailing edge". The columns also have an external face (turned towards the exterior of the column wheel) and an internal face (turned towards hub 46). The external face and internal face meet at the leading edge and the trailing edge. It may be observed that as regards the external face, the profile of the columns forms a circular arc substantially concentric to the column wheel. While on the internal face, the profile of the columns has a larger radius of curvature in the area of the trailing edge than in the area of the leading edge (as is the case with a conventional aeroplane wing).

In FIG. 9, the angle made by the internal face with the external face of a column in the leading edge area is designated "α", and the angle made by the internal face with the external face of a column in the trailing edge area is designated "β". FIG. 9 also shows that the two angles α and β are in reality very rounded. The fact that angle α is very rounded has the advantage of facilitating the progression of the beak of the lever cooperating with the column when the chronograph is operating. As regards angle β, the fact that the angle is rounded does not really have a technical effect and in a variant angle β could be sharp. In the example illustrated, the value of angles α and β is respectively 58 degrees and 31 degrees. According to various embodiments, angle α may vary, but it is preferably comprised between 55 and 65 degrees. Angle β depends on the number of columns comprised in the column wheel, and it will preferably be smaller when the columns are more numerous. However, angle β will preferably be comprised between 25 and 35 degrees.

Finally, the width of a column 44 naturally depends on the number of columns comprised in column wheel 40. However, according to the invention, the columns of the column wheel are wider than the openings arranged between the columns.

FIGS. 3 to 8 are views from the back cover side of a timepiece movement according to a particular embodiment of the invention. The timepiece movement shown is arranged to be integrated in a wristwatch. In these conditions, the crown-pusher which is shown at the top of the Figures would in fact be at three o'clock if one were looking at the dial side of a wristwatch containing the movement. It will thus be clear that, since FIGS. 3 to 8 are views from the back cover side, the "midday" position of the watch is on the right side of the Figures, and the hour circle extends in the anti-clockwise direction in the Figures.

FIGS. 3 to 8 show the same chronograph mechanism according to a particular embodiment of the present invention at different phases of a complete operating cycle. In addition to a column wheel 40, the chronograph mechanism shown includes a chronograph wheel 1, a pivoting coupling part 4 with a beak arranged to cooperate with the column wheel, an oscillating pinion 2 pivoting on a coupling lever 3 and two springs (respectively referenced 5*a* and 5*b*). The coupling lever is arranged to pivot in one direction or the other so as to cause the toothing of oscillating pinion 2 to alternately engage with or be released from the toothing of chronograph wheel 1. Coupling lever 3 pivots in order to stop and restart the chronograph. Indeed, oscillating pinion 2 is permanently driven by the fourth wheel set of the movement gear train (not shown). In these conditions, when the chronograph wheel is meshed with pinion 2, it is driven, and when the oscillating pinion is released from the toothing thereof, the chronograph wheel is uncoupled.

Figure 3:
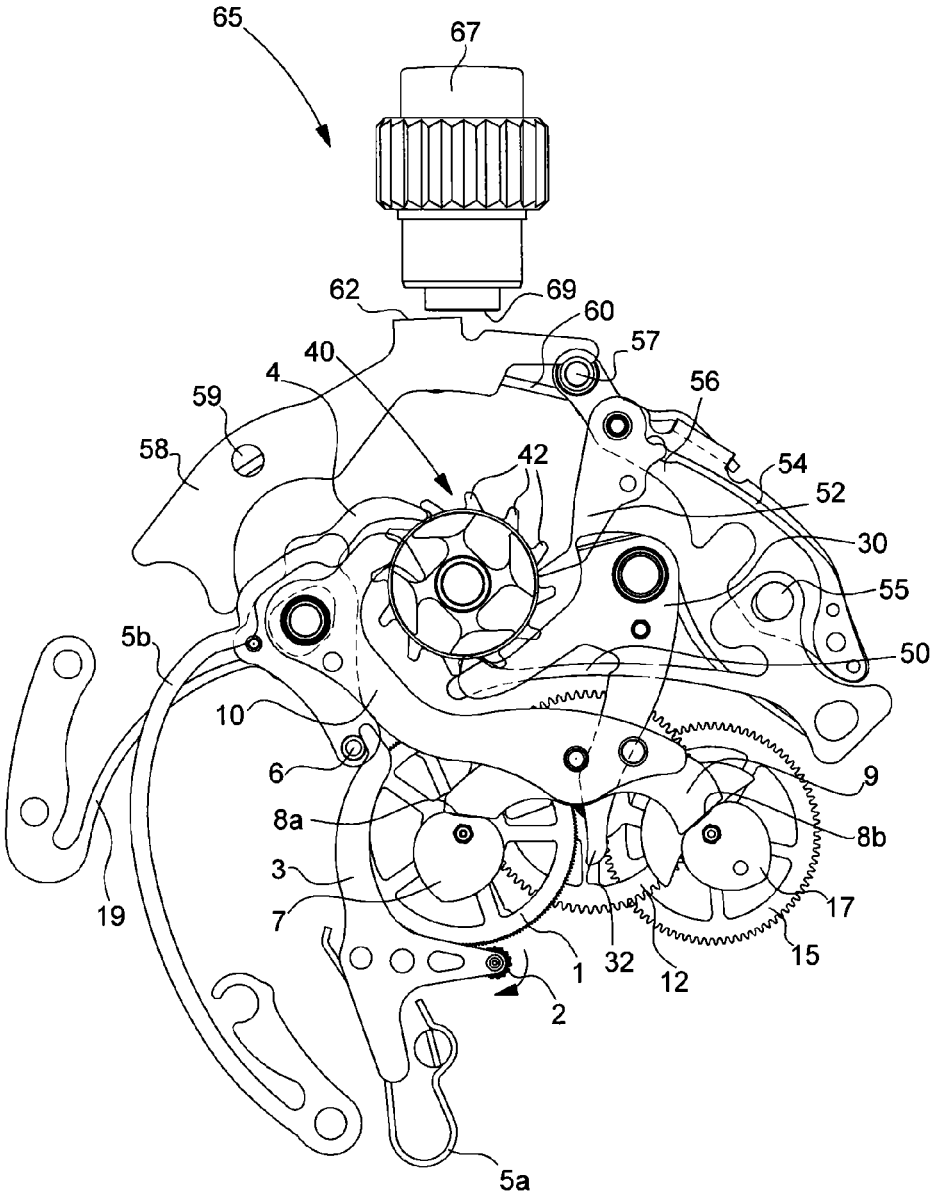
FIG. 3 is a plan view of a chronograph mechanism corresponding to a particular embodiment of the present invention, with the chronograph mechanism reset to zero and ready to start.
Figure 4:
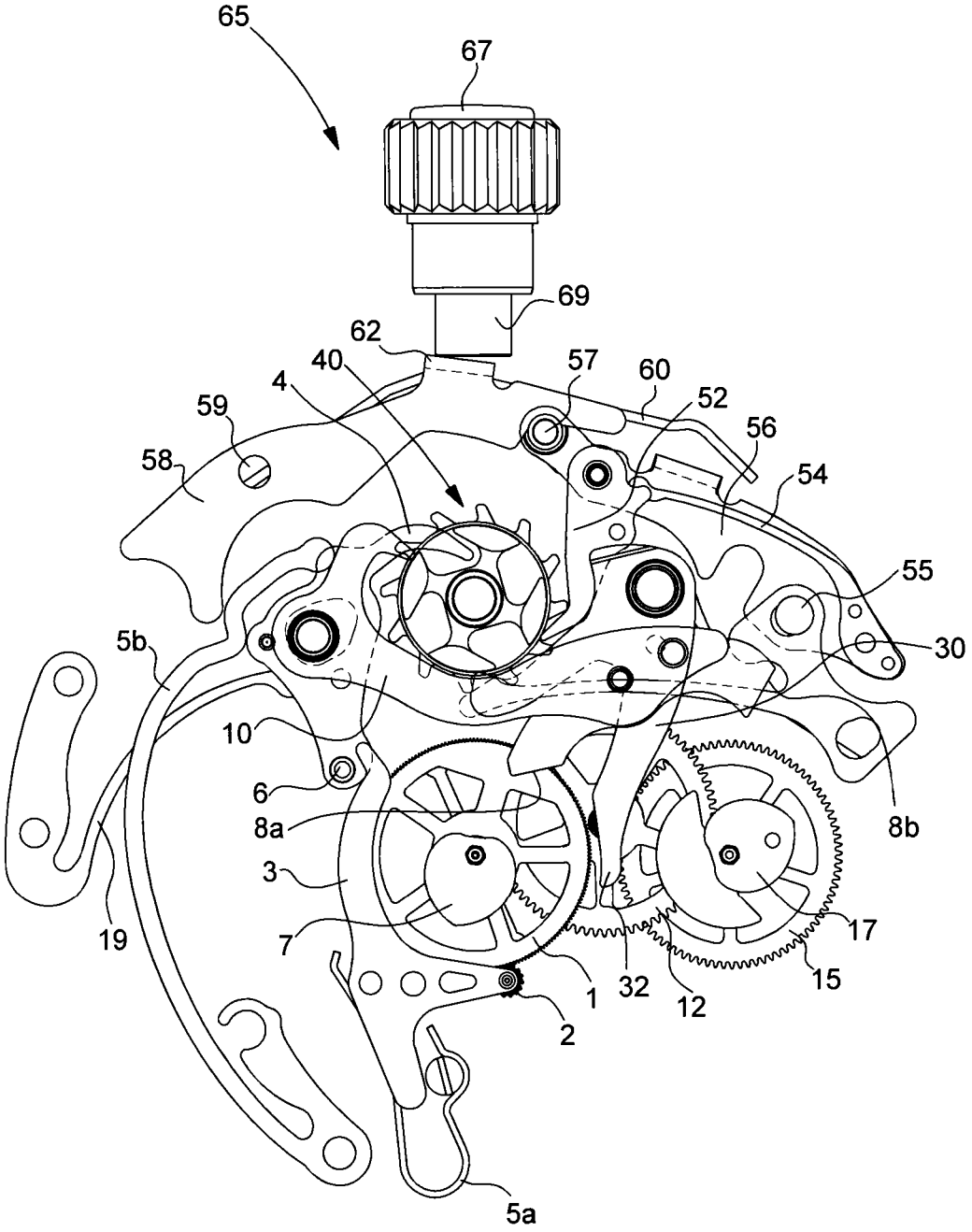
FIG. 4 is a plan view of the chronograph mechanism of FIG. 3 at the moment it is started.
Figure 5:
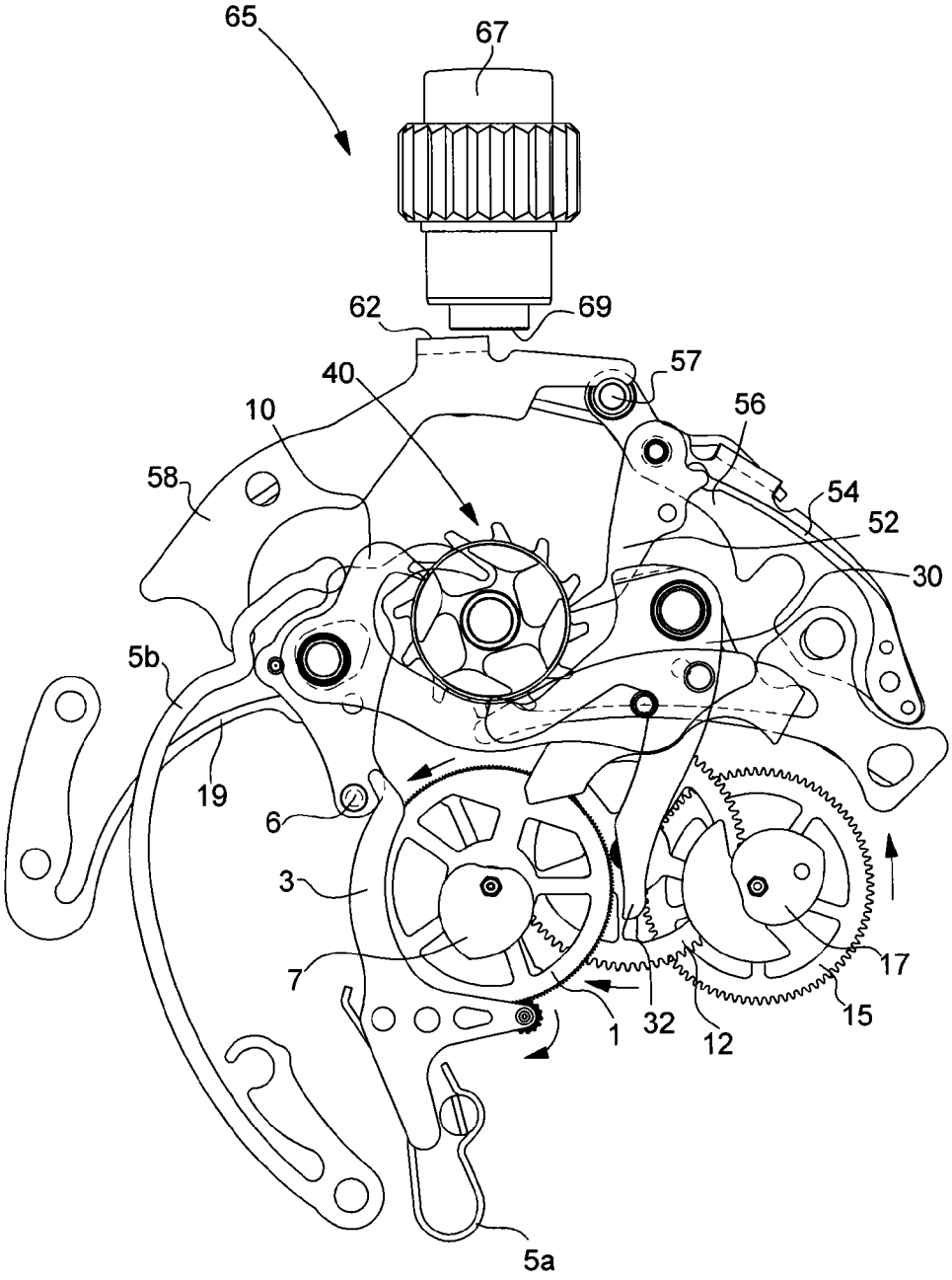
FIG. 5 is a plan view of the chronograph mechanism of FIGS. 3 and 4 during operation.

The purpose of spring 5*a* is to return the coupling lever, and the oscillating pinion that it carries, against the chronograph wheel. Spring 5*b* is arranged to return the beak of the coupling lever against the column wheel. The Figures also show that, at the end opposite the beak, pivoting coupling part 4 carries a pin 6 arranged to cooperate with a corresponding end of coupling lever 3. It can be seen first of all that when the beak of pivoting part 4 is lowered between two columns, as shown in FIGS. 4 and 5 in particular, the pin 6 is moved away from the coupling lever. In these conditions, there is nothing to prevent spring 5*a* meshing oscillating pinion 2 with the toothing of chronograph wheel 1. Conversely, when the beak of the pivoting coupling part is raised by a column of the column wheel, as shown in FIG. 3 in particular, pin 6 forces coupling lever 3 to pivot, which has the effect of moving oscillating pinion 2 away from the toothing of the chronograph wheel. It is therefore column wheel 40 which controls the coupling and uncoupling of chronograph wheel 1.

The chronograph mechanism shown further includes a minute counter wheel 15 and an intermediate wheel 12. Counter wheel 15 is driven by chronograph wheel 1 via intermediate wheel 12. It can also be seen that the arbour of the chronograph wheel and that of the minute counter wheel both carry a reset heart piece (respectively referenced 7 and 17). A hammer with two arms is provided for cooperating with the two heart pieces. This hammer is formed of a reset pivoting part 10 and a moveable pein in the shape of a rudder bar 9. The moveable pein is hinged to one end of pivoting part 10 and it has two sloping portions 8*a*, 8*b* which are each arranged to cooperate with one of heart pieces 7, 17. In a known manner, reset pivoting part 10 is arranged to pivot, either in one direction to lower the hammer against the heart pieces, or in the other direction to raise the hammer. A spring 19 is also arranged to return the hammer against the heart pieces 7, 17 in the rest position. Finally, it is also column wheel 40 which controls the tipping of the hammer.

The chronograph mechanism of the present example further includes a brake formed by a brake lever 30, one of the ends of which carries a shoe 32 arranged to immobilise chronograph wheel 1 by acting on the periphery thereof. In a conventional manner, brake lever 30 is arranged to pivot alternately between a raised position in which shoe 32 is held away from the chronograph wheel and a lowered position in which the shoe blocks the chronograph wheel. A spring (not shown) is also arranged to return shoe 32 against the chronograph wheel in the rest position. Moreover, it is also column wheel 40 which controls the pivoting of brake lever 30.

The chronograph mechanism of the invention further includes a mechanism for controlling the column wheel. This mechanism is a pusher mechanism. In a conventional manner, the pusher mechanism is arranged to gradually increment the angular position of column wheel 40 when a user repeatedly activates the push button of the pusher mechanism. Further, column wheel 40 is held by a column wheel jumper spring (referenced 50 in FIGS. 3 and 6) which presses against the teeth of the ratchet (referenced 42 in FIGS. 9 and 10) so as to hold the column wheel in a stable position.

The pusher mechanism which, in the example shown, connects the button 67 of a crown-pusher 65 to column wheel 40 includes a click 52, a click spring 54, a pivoting control part 56, an intermediate control lever 58 and a control spring 60. In the present example, crown-pusher 65 is arranged at "3 o'clock" at the periphery of the movement and it is associated with a winding and set hands stem (not shown), which extends in the direction of the centre of the movement. The intermediate lever 58 is pivoted on the frame at "4 o'clock" and its slightly bent shape allows it to extend substantially along the periphery of the movement in the interval between "4 o'clock and 2 o'clock". The intermediate lever carries a tongue 62 at 3 o'clock which is turned towards the crown-pusher. This tongue is bent at an angle of around 90° towards the dial side of the movement. The tongue thus forms a flag which approximately faces the crown-pusher. As seen in more detail below, the push button includes a bearing surface 69 which is arranged to press against the flag so as to actuate the intermediate lever of the control mechanism when the push button is actuated.

Pivoting control part 56 is pivoted on the frame at 1 o'clock and its slightly bent shape enables it to extend substantially along the periphery of the movement into proximity with the crown-pusher. Control spring 60 is arranged to cooperate with the pivoting control part 56 so as to return the free end of said pivoting part towards the periphery of the movement. It is also seen that the free end of lever 56 carries a staged post 57 arranged to cooperate with the distal end of intermediate lever 58. It will thus be clear that post 57 allows spring 60 to permanently push back the distal end of lever 58 towards the exterior of the movement. It will also be clear that, conversely, when a user pivots lever 58 by pressing on the push button, this also has the effect of pivoting the pivoting control part 56.

In a known manner, the free end of control lever 56 carries the click (referenced 52) of the pivoting control part. Click 52 pivots freely on the end of the pivoting part and is returned against the ratchet toothing 42 of the column wheel by click spring 54. Click 52 is thus arranged to cooperate with the teeth of ratchet 42 and when, as a result of pressure on the push button, the end of pivoting control part 56 is made to pivot towards the centre of the movement, click 52 accompanies the movement by moving the column wheel forward by the value of one ratchet tooth. Then, as soon as the pressure on the push button is released, control spring 60 makes pivoting part 56 and lever 58 return to their rest position. Click 52 also returns sliding back over the sloping portions of a ratchet tooth. The click is thus ready to actuate the next tooth, when pressure is next applied to the push button.

In a conventional manner, in this example, the push button must be pressed three times for one column to take the place of the preceding one, which corresponds to the three chronograph functions: start, stop and reset. FIG. 3 shows the chronograph mechanism when stopped, after having been reset to zero. All the elements of the chronograph mechanism are stopped with the exception of oscillating pinion 2 which is permanently driven by the gear train of the watch movement (the direction of rotation of the oscillating pinion is indicated by the arrow).

FIG. 4 illustrates the moment that the chronograph mechanism is started. The button 67 of the crown-pusher is pushed in and intermediate lever 58 and pivoting control part 56 have pivoted towards the centre of the movement, driving click 52. This movement of the click moves column wheel 40 forward by 30° in the clockwise direction. The 30° rotation of the column wheel has the effect of raising the beak of reset pivoting part 10, pivoting it to raise the hammer and to release heart pieces 7, 17. Moreover, the rotation of the column wheel also has the effect of dropping the beak of pivoting coupling part 4 into the space between two columns (referenced 44 in FIGS. 9 and 10). As seen above, by allowing the pivoting coupling part to pivot in this way as a result of the action of spring 5, the incrementation of the column wheel also causes the toothing of the oscillating pinion to engage with the toothing of chronograph wheel 1. Finally, the 30° rotation has no effect on the brake, thus the beak remains raised.

FIG. 5 shows the chronograph mechanism in operation. Button 67 of crown-pusher 65 has returned to its rest position, as have intermediate lever 58 and pivoting control part 56. Click 52 has also come back, and is again ready to actuate the next tooth when the push button is actuated again. Chronograph wheel 1, intermediate wheel 12 and minute counter wheel 15 are driven in rotation by oscillating pinion 2 in the direction indicated by the arrows in the Figure.

Figure 6:
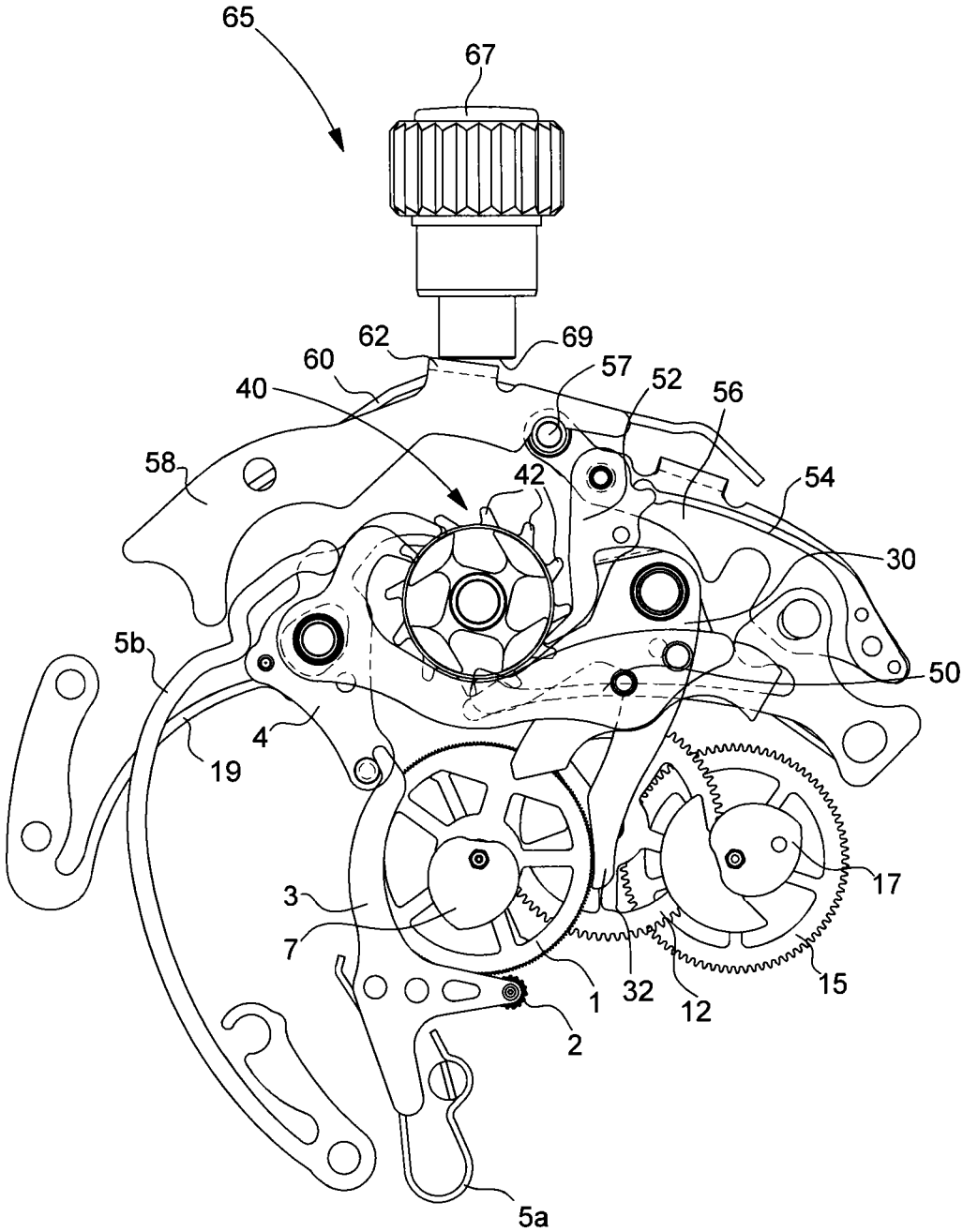
FIG. 6 is a plan view of the chronograph mechanism of FIGS. 3 to 5, at the moment when the mechanism stops.

FIG. 6 illustrates the moment when the chronograph mechanism stops. Following another actuation of the crown-pusher, push button 67 is pushed in and intermediate lever 58 and pivoting control part 56 have again pivoted towards the centre of the movement driving click 52 and rotating the column wheel through 30° again. This new incrementation of the column wheel has the effect, on the one hand, of causing the beak of pivoting coupling part 4 to be raised, causing oscillating pinion 2 to be released from chronograph wheel 1. Moreover, the rotation of the column wheel also has the effect of dropping the beak of brake lever 30 into the space between two columns 44 by pivoting the lever. As seen above, the pivoting of lever 30 lowers shoe 32 against chronograph wheel 1 so that the shoe blocks the chronograph wheel.

Figure 7:
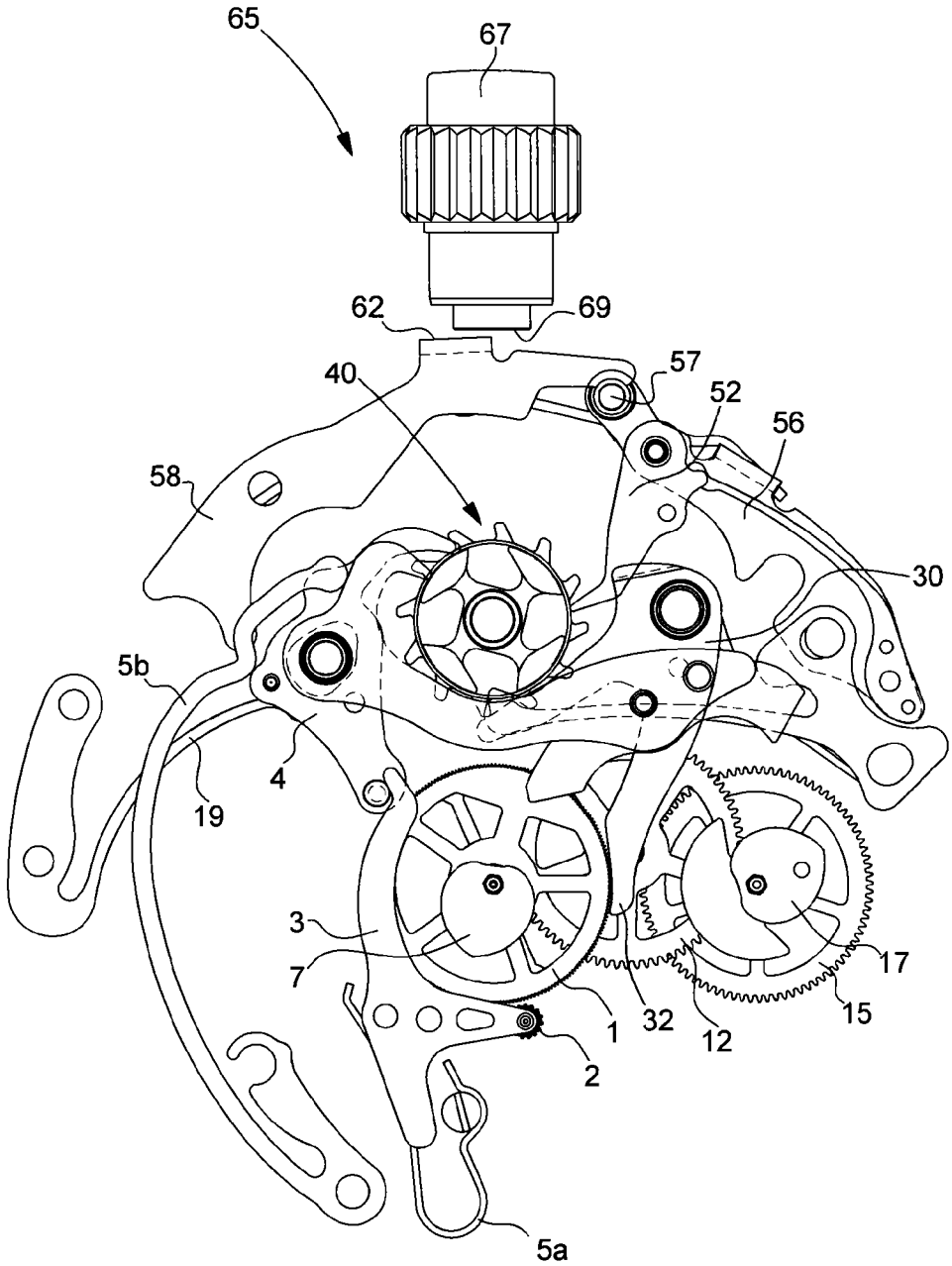
FIG. 7 is a plan view of the chronograph mechanism of FIGS. 3 to 6, when stopped.

FIG. 7 shows the chronograph mechanism stopped. The button of crown-pusher 65 has returned to its rest position, as have intermediate lever 58 and pivoting control part 56. Click 52 has also come back, and is again ready to actuate the next tooth when the push button is actuated again. Shoe 32 of brake lever 30 retains chronograph wheel 1 and minute counter wheel 15 in the position in which the chronograph mechanism was stopped, allowing the time which elapsed between the start and stop of the chronograph mechanism to be read.

Figure 8:
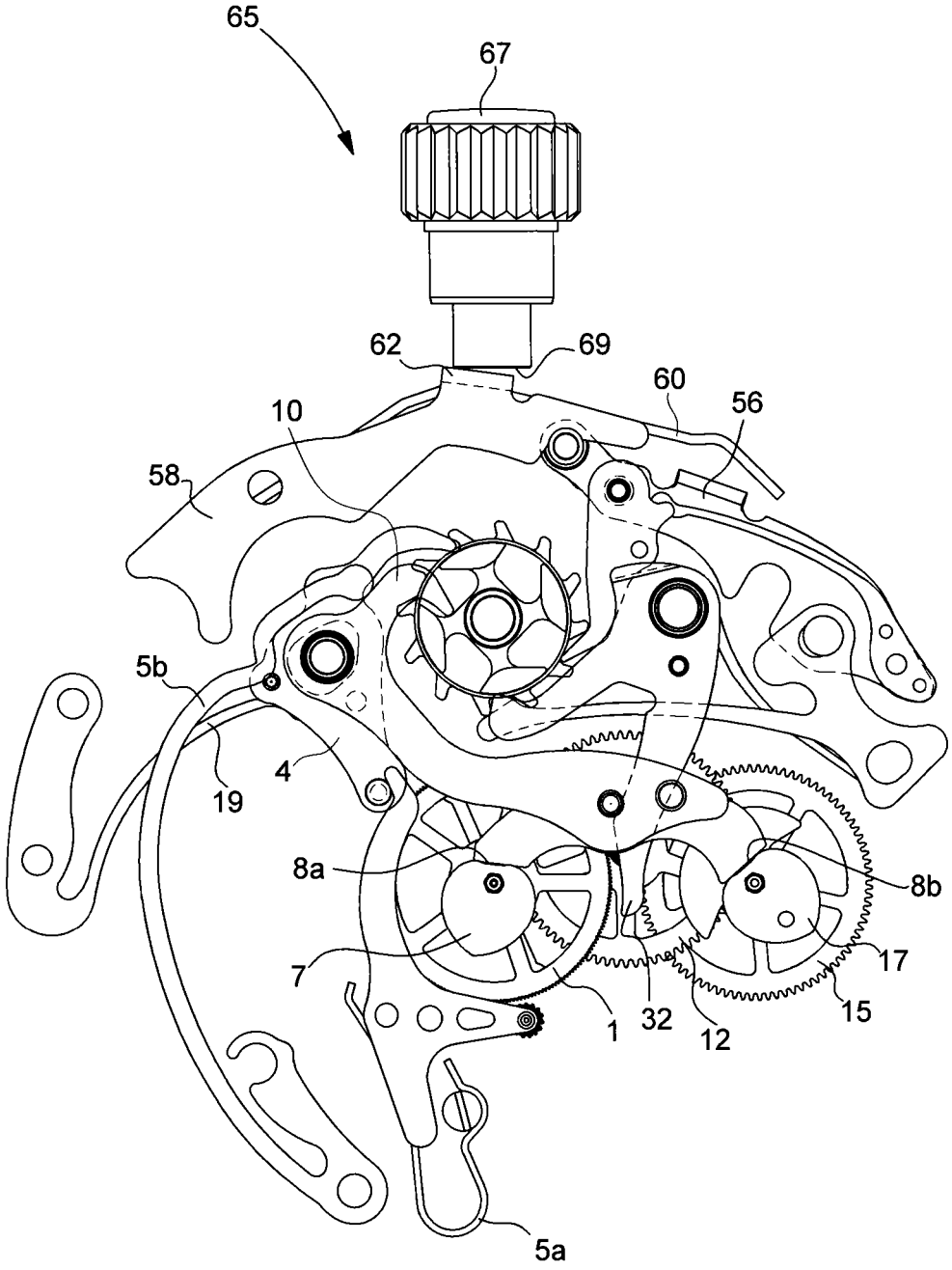
FIG. 8 is a plan view of the chronograph mechanism of FIGS. 3 to 7, at the moment when the mechanism is reset to zero.

FIG. 8 shows the moment that the chronograph mechanism is reset to zero. Following another actuation of the crown-pusher, push button 67 is pushed in and intermediate lever 58 and pivoting control part 56 have again pivoted towards the centre of the movement driving click 52 and incrementing the column wheel through 30° again. This new incrementation of the column wheel has the effect, on the one hand, of raising the beak of brake lever 30, causing shoe 32 to move away from chronograph wheel 1. Moreover, the rotation of the column wheel also has the effect of dropping the beak of reset pivoting part 10 into the space between two columns 44 and thereby pivoting the pivoting part. The effect of the pivoting of the pivoting part is to lower the two sloping portions 8*a* and 8*b* of the hammer respectively against the two heart pieces 7, 17 so as to return chronograph wheel 1 and minute counter wheel 15 to their respective start positions.

Figure 1:
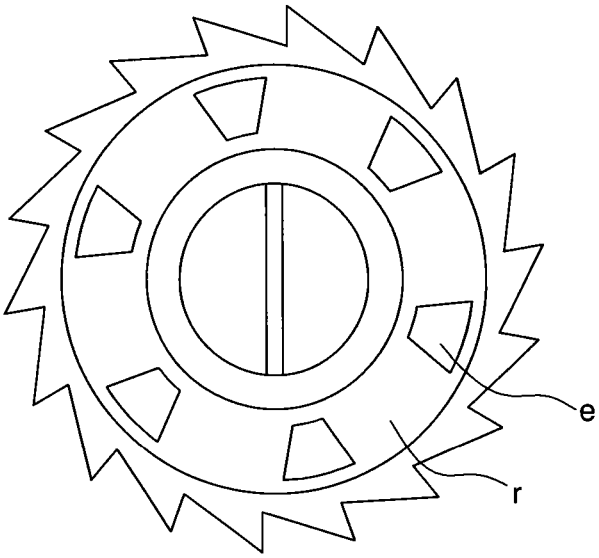
Fig. 1 (Prior Art)
FIG. 1 is a top plan view of a three-stroke column-wheel of the prior art.
Figure 2:
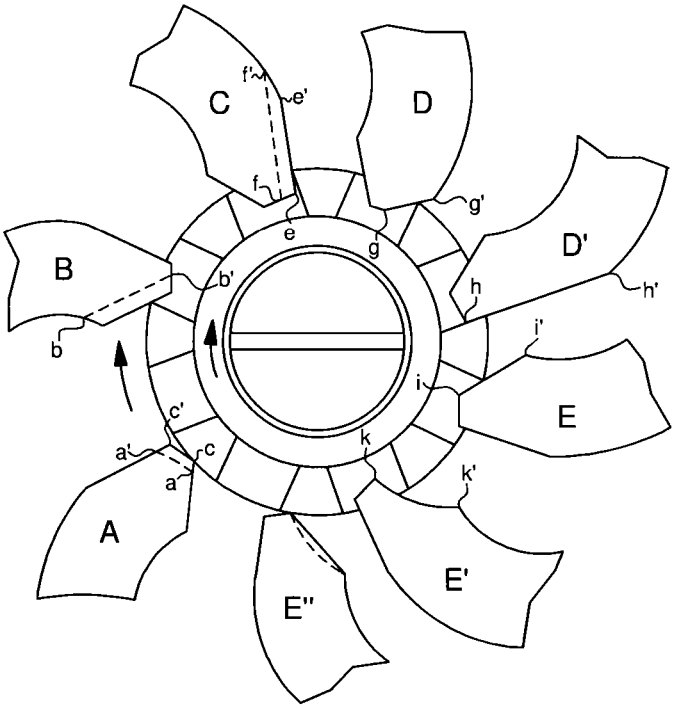
Fig. 2 (Prior Art)
FIG. 2 is a schematic top plan view illustrating various possible interactions between columns and beaks of pivoting parts in a prior art chronograph mechanism.

Referring again to FIGS. 3 to 8, it will be noted that, if the beak of pivoting coupling part 4 and of reset pivoting part 10 are compared to those shown in FIG. 2, it is immediately evident that the beaks of the chronograph movement according to the present invention can be much more tapered than those of the prior art. One advantage of this feature is that a tapered beak (the point of which forms an angle of less than 40°; and preferably an angle of less than 30°, allows the pivoting parts of the chronograph mechanism of this example to be lowered even into the relatively narrow space formed by the gap between two columns of the column wheel illustrated in FIG. 10 for example. As a corollary, it will also be clear that the use of tapered beaks like those of the pivoting parts of the chronograph mechanism of this example requires wider columns in return to prevent the beaks from lowering ill-advisedly.

What is claimed is:

1. A column-wheel for a three stroke chronograph mechanism, comprising:

a ratchet provided with 3*n teeth, where n is equal to or greater than 4;

a central hub; and a superstructure coaxial to the column-wheel and exhibiting n-fold rotational symmetry, the superstructure comprising n radial arms and n columns parallel to an axis of rotation of the column-wheel, the columns being regularly distributed along the circumference of the column-wheel and separated from each other by n empty spaces forming as many openings between the columns, each column including an external face and an internal face connected to each other by a leading edge and by a trailing edge, the external face having a rounded shape concentrically to the axis of rotation of the column-wheel, and the internal face being connected to the hub by a radial arm, wherein a width of the columns measured between the leading edge and the trailing edge is larger than a width of the openings between the columns, and wherein a width of the arms at a narrowest point thereof is less than half the width of the columns, wherein a height of the hub and the arms is comprised between 20 and 60% of a height of the columns, wherein in a transverse section, the internal face of the columns has a convex shape in a part of the columns that exceeds the height of the arms, a radius of curvature of the internal face being larger in an area of the trailing edge than in an area of the leading edge, wherein an angle formed by the internal face of one column with the external face in the area of the leading edge is comprised between 55° and 65° , and wherein an angle formed by the internal face of one column with the external face in the area of the trailing edge is comprised between 25° and 35° .

2. The column-wheel according to claim 1, wherein n=4.

3. The chronograph mechanism including a column-wheel according to any of claims 1 or 2 and at least one pivoting part whose beak is arranged to cooperate with the columns of the column-wheel.

4. The chronograph mechanism according to claim 3, wherein said beak of the pivoting part has a point which forms an angle of less than 40° .

5. The chronograph mechanism according to claim 4, wherein said point forms an angle of less than 30° .

6. The chronograph mechanism according to claim 3, wherein said pivoting part is a pivoting coupling part.

7. The chronograph mechanism according to claim 3, wherein said pivoting part is a reset pivoting part.

* * * * *